United States Patent [19]

Chiba et al.

[11] 4,092,099

[45] May 30, 1978

[54] COPIER PAPER DELIVERY MEANS IN A HEAT-FIXING DEVICE OF A COPYING MACHINE

[75] Inventors: Satoshi Chiba; Kazunori Ishihara; Kazuo Saito; Kazunobu Yamamoto, all of Ebina, Japan

[73] Assignee: Rank Xerox, Ltd., London, England

[21] Appl. No.: 766,814

[22] Filed: Feb. 8, 1977

[51] Int. Cl.[2] ..... F27B 9/28; F27D 15/02

[52] U.S. Cl. ..... 432/59; 432/77; 355/3 FU; 271/80; 271/272; 165/186; 219/216

[58] Field of Search ..... 432/59, 60, 8, 77; 198/620; 219/216, 469; 165/2, 186; 355/3 FU; 271/80, 272, 273, 274

[56] References Cited

U.S. PATENT DOCUMENTS

| | | | |
|---|---|---|---|
| 2,201,605 | 5/1940 | Backhouse | 271/272 |
| 3,374,769 | 3/1968 | Carlson | 432/60 |
| 3,450,402 | 6/1969 | Weiler | 271/80 |
| 3,716,018 | 2/1973 | Ohta et al. | 432/60 |
| 3,847,388 | 11/1974 | Lynch | 271/80 |
| 3,929,095 | 12/1975 | Thettu | 432/60 |

FOREIGN PATENT DOCUMENTS

| | | | |
|---|---|---|---|
| 659,462 | 3/1963 | Canada | 271/80 |
| 1,418,173 | 12/1975 | United Kingdom | 432/59 |

*Primary Examiner*—John J. Camby
*Assistant Examiner*—Henry C. Yuen

[57] ABSTRACT

A thermal fusing device for softening toner images is provided in combination with a transport at the exit of the fuser which transport is characterized by a pair of nip-forming members one of which is provided with a plurality of recesses for receiving belt structures fabricated from a silicone rubber material. A second roll is provided also having recesses for receiving the belts and this roll is positioned remotely from the first mentioned roll so that the belts are entrained about the two rolls such that they protrude from the recesses to thereby provide a nip-forming roll wherein only the belts contact the toner material carried by the copy substrate. Additionally, a fan is provided for cooling the surface of the belt so that the toner will more readily solidify and the paper can be stripped therefrom due to the beam strength of the paper.

7 Claims, 6 Drawing Figures

COPIER PAPER DELIVERY MEANS IN A HEAT-FIXING DEVICE OF A COPYING MACHINE

BACKGROUND OF THE INVENTION

This invention relates to a copy paper delivering means in a heat-fixing device of a xerographic copying machine.

A copy paper or copy substrate delivering means of this sort has heretofore been known, for example, such a mechanism is shown in FIG. 1, in which a delivery roller 3 is provided on the delivery side of the heat-fixing device 2 such as a fuser 1 whereby a heat-fixed copy paper 4 is delivered by means of the roller 3. That is to say that the roller 3 acts as an exit transport from the radiant fuser 2.

Such a conventional contruction has the disadvantage that the temperature of the delivery roller 3 rises due to the radiant energy transmitted from the heat-fixing device 2 and heat from a copier paper 4 because the delivery roller 3 is located in the proximity of the heat-fixing device 2, resulting in the toner forming the image on the copy paper 4 adhering to the surface of the roller 3, and consequently adhering to subsequent copier papers resulting in the latter becoming contaminated or dirty.

In view of the drawbacks mentioned above, there has been proposed in the prior art a construction as shown in FIG. 2 in which the delivery roller 3 comprises a roller body 3*a* and equally spaced annular projections 3*b* so as to reduce the area in contact with the copy paper. Also in such construction, however, the toner adheres to the annular projections 3*b* thus causing subsequent papers to become dirty.

Such a disadvantageous phenomenon may be eliminated if the delivery roller 3 is prevented from rising in temperature, that is, if the roller 3 is kept away from the heat-fixing device 2. Such a construction, however, requires means for conveying the copy paper 4 from the heat-fixing device 2 to the delivery roller 3, resulting in the need for making the copying machine larger.

Accordingly, the primary object of this invention is to provide a new and improved exit transport device for a fuser utilized in a xerographic copier.

Another object of this invention is to provide a new and improved exit transport for moving copy substrates out of a fuser used for fixing toner images wherein the transport provides minimal contact of abhesive surfaces with the toner images to thereby minimize the offset of toner to the exit transport device.

Still another object of this invention is to provide a new and improved exit transport device utilized in conjunction with a toner fuser which is cooled in order to minimize the offset of toner to the transport.

BRIEF SUMMARY OF THE INVENTION

Briefly, the above-cited objects of the present invention are accomplished by the provision of a transport device utilized for transporting copy substrates from the exit of a fuser wherein the transport is so constructed as to minimize the offset of toner thereto. To this end, the transport device comprises a pair of nip-forming members one of which has a plurality of belts received in recesses formed in one of the nip-forming members such that as the copy paper with the toner images thereon passes through the nip the surfaces of the belt which protrude from the recesses contact the toner on the copy substrate thereby providing minimum contact of a transport device with such toner. Additionally, a fan is provided to cool the belts to thereby effect solidification of the toner prior to stripping which also aids in minimizing the offset of toner to the belt members.

Other objects and advantages of the present invention will become apparent when read in conjunction with the accompanying drawings wherein:

DETAILED DESCRIPTION OF THE PREFERRED EMBODIMENT

Figure 1:
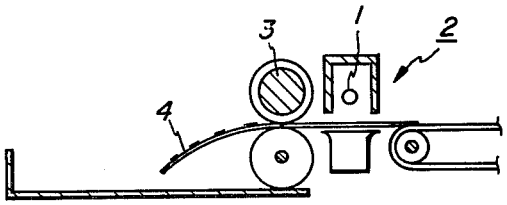
FIG. 1 is a view illustrating the prior art.
Figure 2:
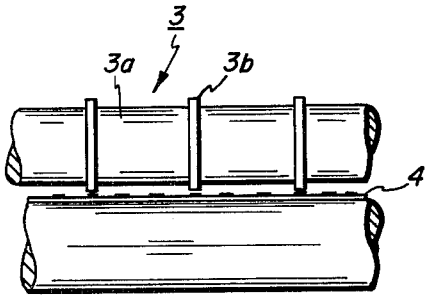
FIG. 2 is a view illustrating an improved, conventional delivery roller of the prior art.
Figure 3:
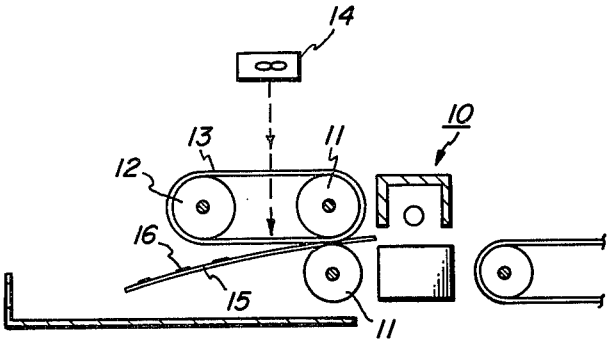
FIG. 3 is a view illustrating an embodiment of the present invention.
Figure 4:
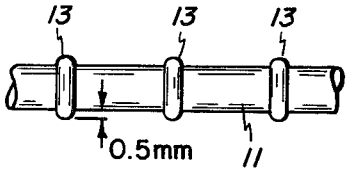
FIG. 4 is a view illustrating the relation between belts and delivery rollers of the embodiment of FIG. 3.

The present invention has been accomplished in view of the foregoing circumstances. In accordance with the objects of the invention, a copy paper delivering means in a heat-fixing device of a copying machine is provided which delivering means is of a simple construction and is capable in a positive manner of preventing subsequent copy papers from becoming dirty from toner offsetting thereto. For illustration of an embodiment of the present invention, there is now presented the following description taken in connection with FIGS. 3 through 6.

In the drawing, the reference numeral 10 is a heat-fixing device, 11 first delivery rollers, 12 a second delivery roller, 13 belts and 15 copy paper.

On the delivery side of the heat-fixing device is provided, in the proximity thereof, a pair of first delivery or nip forming rollers 11. A second delivery roller 12 is provided in opposed and spaced relation to the upper roller of said first rollers 11. A plurality of endless belts 13 are mounted on the second delivery roller 12 and the upper roller of the first delivery rollers 11 so that the belts 13 are projected on the periphery of the first roller 11. To this end, the belts are disposed in recesses in the upper roller 11 and the roller 12.

With such a construction, a copy paper 15 is delivered in contact with the belts 13 and, since the belts 13 are cooled with a fan 14, toner particles 16 on the copy paper 15 do not adhere to the belts 13 and thus subsequent copy paper 15 will be free from dirt.

It is most preferable that the belts 13 have a thickness about 0.5 mm projecting on the periphery of the delivery rollers 11 and 12, and that they are made of material to which toner is difficult to adhere such as silicone rubber and are in the form of a ring of circular or annular section.

Figure 5:
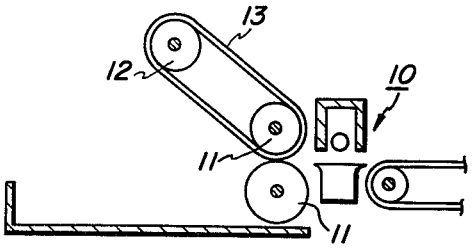
FIG. 5 is a view illustrating another embodiment of the invention.
Figure 6:
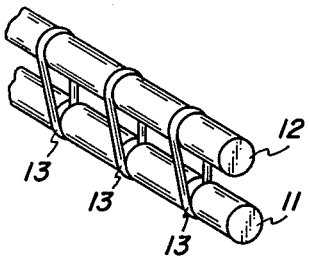
FIG. 6 is a perspective view illustrating the condition of belts applied.

As shown in FIGS. 5 and 6, the second delivery roller 12 may be located in an upper position and the belts 13 inclined.

Also, though in the embodiment the belts 13 are forcibly cooled with the fan 14, there may be applied a natural cooling by means of natural convection.

In the present invention as described above, the copy paper 15 is delivered in contact with the belts 13 which have been thoroughly cooled because they extend from one of the first delivery rollers 11 to the spaced and opposed second delivery roller 12. Consequently, the toner never adheres to the belts 13, so that, with such a simple construction alone, that is, with the provision of only the second delivery roller 12 and belts 13, subsequent copy papers can positively be prevented from becoming dirty.

It will be appreciated that the rolls 11 and 12 are adapted to be rotated in conventional manner employed in the xerographic arts.

While the invention has been described with respect to the preferred embodiments it will be apparent that certain modifications and changes can be made without departing from the spirit and scope of the invention and it is therefore intended that the foregoing disclosure be limited only by the claims attendant hereto.

What is claimed is:

1. Fuser apparatus for fixing toner images to copy substrates, said apparatus comprising:

means for softening toner images on said copy substrates;

means for conveying said copy substrates to said softening means with said toner images in a predetermined orientation whereby said toner images are exposed to said softening means;

means for transporting said substrates from said toner softening means, said transporting means including nip forming members through which the copy substrates are moved;

one of said nip forming members comprising a roll member having a plurality of circumferential recesses therein, receiving a plurality of belt members which belt members protrude beyond the surface of the roll member whereby they contact the toner image side of the substrates and the surface of the roll member does not;

a second roll member also having recesses therein for receiving said belt members, said first and second roll members being adapted to be rotated along with the other of said nip forming members to thereby transport said copy substrates away from said toner softening means;

said first nip forming member being disposed intermediate said second roll member and said toner softening means.

2. Apparatus according to claim 1 including means for cooling said belts.

3. Apparatus according to claim 2 wherein said belt cooling means comprises a fan.

4. Apparatus according to claim 1 wherein said belts are fabricated from an abhesive material.

5. Apparatus according to claim 4 including means for cooling said belts.

6. Apparatus according to claim 1 wherein said second roll member is disposed above said first roll member whereby said belts are inclined.

7. Apparatus according to claim 5 wherein said belts are fabricated from silicone rubber.

* * * * *